US010185271B2

(12) United States Patent
Nishioka

(10) Patent No.: US 10,185,271 B2
(45) Date of Patent: Jan. 22, 2019

(54) SHEET ACCOMMODATING CASSETTE AND IMAGE FORMING APPARATUS INCLUDING THE SAME

(71) Applicant: KYOCERA Document Solutions Inc., Osaka (JP)

(72) Inventor: Nobuhiro Nishioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/816,581

(22) Filed: Nov. 17, 2017

(65) Prior Publication Data

US 2018/0143576 A1 May 24, 2018

(30) Foreign Application Priority Data

Nov. 22, 2016 (JP) ..... 2016-226951

(51) Int. Cl.

| | |
|---|---|
| ***B65H 1/12*** | (2006.01) |
| ***G03G 15/00*** | (2006.01) |
| ***B65H 1/04*** | (2006.01) |
| ***B65H 1/14*** | (2006.01) |
| *B65H 3/54* | (2006.01) |

(52) U.S. Cl.

CPC ..... *G03G 15/6508* (2013.01); *B65H 1/04* (2013.01); *B65H 1/12* (2013.01); *B65H 1/14* (2013.01); *B65H 3/54* (2013.01); *B65H 2801/03* (2013.01)

(58) Field of Classification Search

CPC ... B65H 2402/63; B65H 2403/73; B65H 3/54

See application file for complete search history.

(56) References Cited

U.S. PATENT DOCUMENTS

| | | | | |
|---|---|---|---|---|
| 4,535,982 | A * | 8/1985 | Mochimaru | B65H 1/266 271/127 |
| 5,961,113 | A * | 10/1999 | Morris | B65H 1/12 271/127 |
| 6,862,426 | B2 * | 3/2005 | Kitamura | G03B 27/00 271/145 |
| 2018/0237244 | A1 * | 8/2018 | Hashimoto | G03G 15/6511 |

FOREIGN PATENT DOCUMENTS

| | | |
|---|---|---|
| JP | H11-79420 A | 3/1999 |

* cited by examiner

*Primary Examiner* — Howard J Sanders

(74) *Attorney, Agent, or Firm* — Studebaker & Brackett PC

(57) ABSTRACT

A sheet accommodating cassette includes a sheet accommodating section, a sheet loading plate, and a lift mechanism. The lift mechanism includes a rotary shaft, a push-up plate, a coupling member, an actuator, and an urging member. The push-up plate lifts up and down the sheet loading plate by pivoting about the rotary shaft. Driving force is input from a cassette attachment section to the coupling member. The actuator projects from an end of the rotary shaft. The urging member urges the actuator in a direction in which the sheet loading plate pivots toward the lowered position.

6 Claims, 4 Drawing Sheets

SHEET ACCOMMODATING CASSETTE AND IMAGE FORMING APPARATUS INCLUDING THE SAME

INCORPORATION BY REFERENCE

The present application claims priority under 35 U.S.C. § 119 to Japanese Patent Application No. 2016-226951, filed on Nov. 22, 2016. The contents of this application are incorporated herein by reference in their entirety.

BACKGROUND

The present disclosure relates to a sheet accommodating cassette and an image forming apparatus including the sheet accommodating cassette, and particularly to a sheet accommodating cassette that includes a sheet loading plate and a lift mechanism that lifts up and down the sheet loading plate, and an image forming apparatus including the sheet accommodating cassette.

A paper feed cassette (a sheet accommodating cassette) is used for feeding paper such as cut paper in an image forming apparatus such as a copier or a printer. A large number of sheets of paper to be printed are kept in stock in the paper feed cassette in advance. A paper feed roller, a pickup roller, and the like located in the vicinity of the paper feed cassette feed the paper sheet by sheet from the uppermost sheet by separating each sheet from a stack of the paper in the paper feed cassette.

A known paper feed cassette includes a sheet loading plate for placing paper on an upper surface thereof. An upstream end of the sheet loading plate in a paper feed direction is supported within the paper feed cassette. The sheet loading plate is pivotable about a pivot with its downstream end in the paper feed direction being a pivotable end (free end). Also, the paper feed cassette includes a lift mechanism that lifts up and down the pivotable end of the sheet loading plate.

For example, the lift mechanism includes: a push-up plate that comes into contact with the underside of the sheet loading plate and lifts up and down the pivotable end of the sheet loading plate; a rotary shaft to which the push-up plate is fixed; and a connecting member that is fixed to an end of the rotary shaft opposite to an end to which the push-up plate is fixed and that includes a rotary shaft-side coupling member and a gear to which driving force is input from a main body of the image forming apparatus. The main body of the image forming apparatus includes an output section including a coupling member and a gear that is connected to the connecting member and transmits the driving force. The connecting member is connected with the output section when the paper feed cassette is attached to the main body of the image forming apparatus. When the driving force is transmitted to the connecting member and the rotary shaft rotates forward, the push-up plate pivots upward and lifts the sheet loading plate.

SUMMARY

A sheet accommodating cassette of the present disclosure is attachable to and detachable from a cassette attachment section of an apparatus main body. The sheet accommodating cassette includes a sheet accommodating section, a sheet loading plate, and a lift mechanism. The sheet accommodating section accommodates sheets. The sheet loading plate is supported on a bottom surface portion of the sheet accommodating section to pivot, and the sheets are loaded on the sheet loading plate. The lift mechanism causes the sheet loading plate to pivot between a lowered position and a lifted position. The lowered position is a position at which the sheet loading plate lies down along the bottom surface portion. The lifted position is a position that is located above the lowered position to feed the sheets. The lift mechanism includes a rotary shaft, a push-up plate, a coupling member, an actuator, and an urging member. The rotary shaft is supported in the sheet accommodating section and extends in a width direction perpendicular to a feeding direction of the sheets. The push-up plate projects from the rotary shaft and lifts up and down the sheet loading plate by pivoting about the rotary shaft while a distal end of the push-up plate is in contact with a lower surface of the sheet loading plate. The coupling member is provided at an end of the rotary shaft, and driving force is input from the cassette attachment section to the coupling member. The actuator projects from the end of the rotary shaft. The urging member urges the actuator in a direction in which the sheet loading plate pivots toward the lowered position.

An image forming apparatus according to another aspect of the present disclosure includes the above-described sheet accommodating cassette, the apparatus main body, and an image forming section. The apparatus main body includes the cassette attachment section. The image forming section is located within the apparatus main body.

DETAILED DESCRIPTION

The following describes an embodiment of the present disclosure with reference to the drawings.

Figure 1:
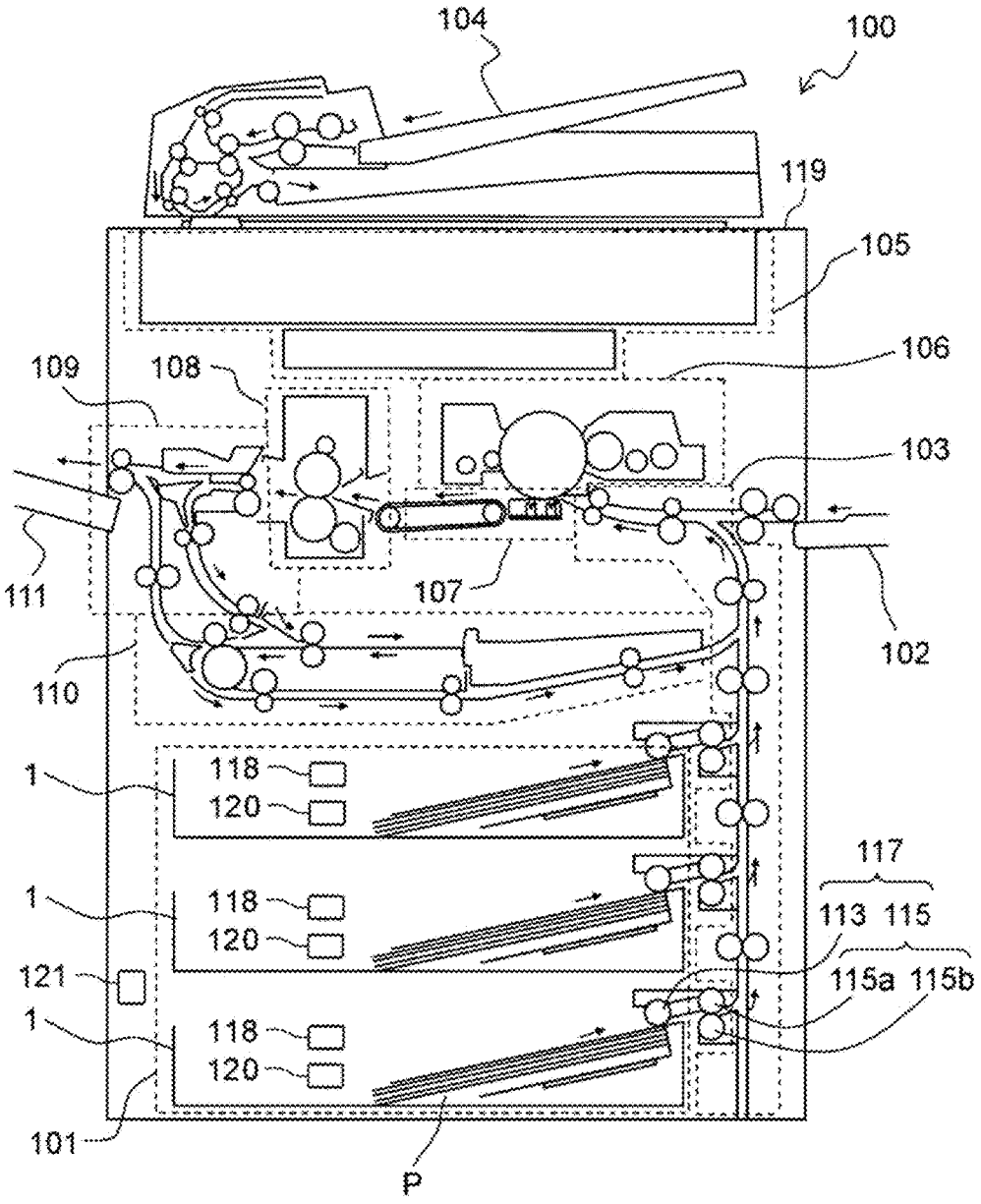
FIG. 1 is a cross-sectional view illustrating an internal structure of an image forming apparatus equipped with paper feed cassettes according to an embodiment of the present disclosure.

FIG. 1 is a cross-sectional view illustrating an internal structure of an image forming apparatus 100 equipped with paper feed cassettes 1 according to the embodiment of the present disclosure. Note that solid line arrows in FIG. 1 indicate conveyance directions of paper.

In FIG. 1, a cassette attachment section 101 is provided in a lower part of the main body (apparatus main body) of the image forming apparatus 100. The main body of the image forming apparatus 100 refers to a housing 119 of the image forming apparatus 100, for example. A plurality of (here, three) paper feed cassettes (sheet accommodating cassettes) 1 are attached to the cassette attachment section 101. The following describes one of the plurality of paper feed cassettes 1. The paper feed cassette 1 is attachable to and detachable from the cassette attachment section 101. The paper feed cassette 1 accommodates cut paper (sheets) P for printing. The paper P is stacked within the paper feed cassette 1. A paper feed mechanism 117 feeds the paper P sheet by sheet by separating each sheet from the stack of the paper. The paper feed mechanism 117 includes a pickup roller 113 and a paper feed roller pair 115. The paper feed roller pair 115 includes a feed roller 115*a* and a retard roller 115*b*.

A manual paper feed section 102 is provided outside the image forming apparatus 100 at an upper part of the right side surface of the image forming apparatus 100. Paper P of a size or a thickness different from that of the paper P in the paper feed cassette 1, an OHP sheet, an envelope, or a post card is placed on the manual paper feed section 102.

A paper conveyance section 103 is located within the image forming apparatus 100. The paper conveyance section 103 is located downstream of the paper feed mechanism 117 of the cassette attachment section 101 and the manual paper feed section 102 in a paper feed direction (a sheet feed direction). In the present embodiment, the paper feed direction refers to a direction of travel of the paper P fed from the cassette attachment section 101 or the manual paper feed section 102 to an image forming section 106. The paper P fed from the paper feed cassette 1 is conveyed by the paper conveyance section 103 vertically upward along a side surface of the main body of the image forming apparatus 100. The paper P fed from the manual paper feed section 102 is conveyed horizontally from the side surface of the main body of the image forming apparatus 100.

A document conveyor device 104 is located on the top surface of the image forming apparatus 100. An image reading section 105 is located below the document conveyor device 104. The document conveyor device 104 feeds a document sheet by sheet by separating each sheet from other sheets of the document. The image reading section 105 reads image data from the document.

The image forming section 106 and a transfer section 107 are located downstream of the paper conveyance section 103 in the conveyance direction of the paper. The image forming section 106 forms an electrostatic latent image of a document image on the basis of the image data read by the image reading section 105, and forms a toner image by developing the electrostatic latent image. In synchronization with the formation of the toner image by the image forming section 106, the paper conveyance section 103 conveys the paper P from the paper feed cassette 1 to the transfer section 107. The transfer section 107 transfers the toner image formed by the image forming section 106 onto the paper P.

A fixing section 108 is located downstream of the transfer section 107 in the conveyance direction. The paper P to which the unfixed toner image has been transferred by the transfer section 107 is conveyed to the fixing section 108. The paper P conveyed to the fixing section 108 passes through a nip part between a fixing roller pair consisting of a heating roller and a pressure roller. Through the above, the unfixed toner image is fixed to the paper P.

An ejecting-diverging section 109 is located downstream of the fixing section 108 in the conveyance direction. When duplex printing is not performed, the ejecting-diverging section 109 ejects the paper P ejected from the fixing section 108 to a paper exit tray 111.

A duplex printing unit 110 is located above the cassette attachment section 101. When duplex printing is performed, the ejecting-diverging section 109 sends the paper P ejected from the fixing section 108 to the duplex printing unit 110. The paper P sent to the duplex printing unit 110 is turned upside down via a switchback. The paper P turned upside down passes through the paper conveyance section 103 again. The paper P is conveyed to the transfer section 107 in a state where a surface of the paper P that has not been printed faces upward.

Figure 2:
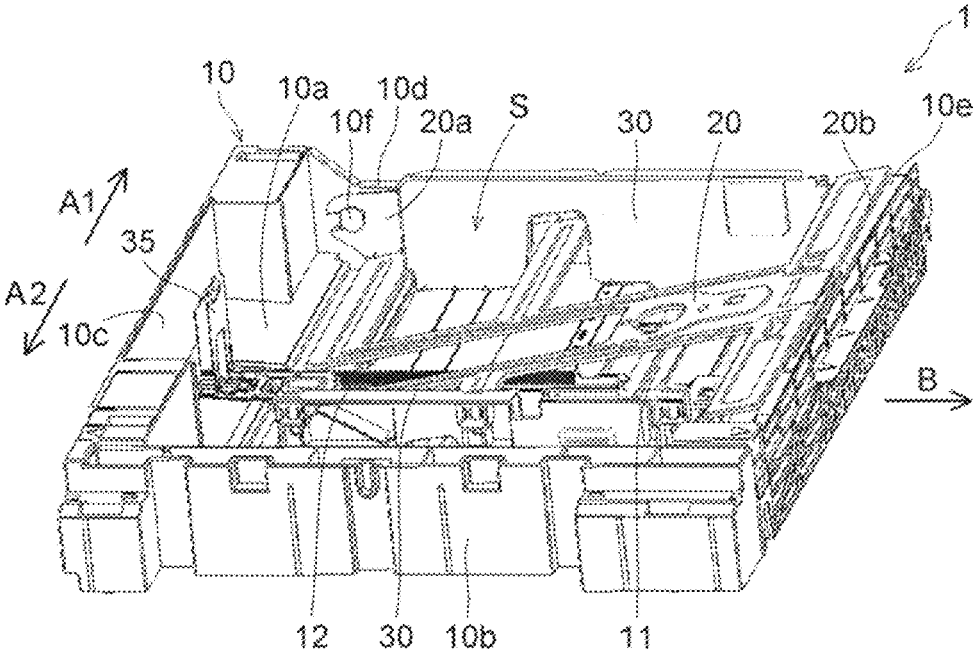
FIG. 2 is a perspective view of a paper feed cassette according to the embodiment of the present disclosure, taken from above in front of the paper feed cassette.
Figure 3:
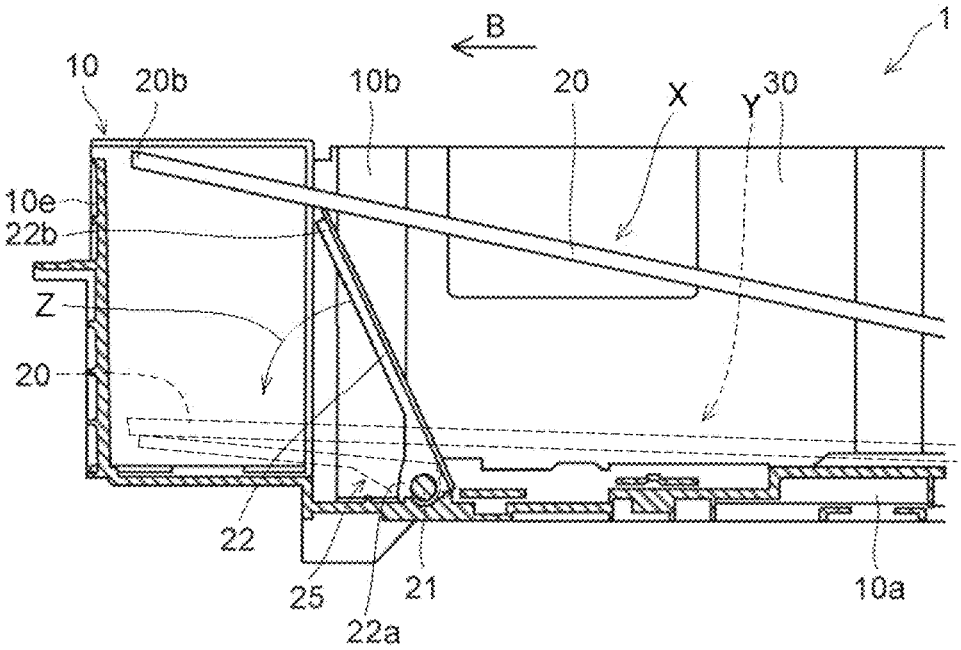
FIG. 3 is a sectional side view illustrating a structure of the vicinity of a push-up plate of the paper feed cassette according to the embodiment of the present disclosure.

Next, the following describes details of a configuration of the paper feed cassette 1 according to the embodiment of the present disclosure. FIG. 2 is a perspective view of the paper feed cassette 1 according to the embodiment of the present disclosure, taken from above in front of the paper feed cassette 1. FIG. 3 is a sectional side view illustrating a structure of the vicinity of a push-up plate 22 of the paper feed cassette 1 according to the embodiment of the present disclosure. Note that FIG. 3 is a view taken from the rear sides of FIGS. 1 and 2. Therefore, the left and right in FIG. 3 are reversed as compared with FIGS. 1 and 2.

The paper feed cassette 1 is supported so as to be slideable along an unillustrated rail provided on the main body of the image forming apparatus 100. The paper feed cassette 1 slides along the rail in a direction perpendicular to the plane of FIG. 1 to be inserted into the cassette attachment section 101 from the front side of FIG. 1. In the present embodiment, the paper feed cassette 1 slides parallel to a direction indicated by an arrow A1 in FIG. 2. Note that the paper P is fed in a direction indicated by an arrow B in FIG. 2.

The paper feed cassette 1 includes a cassette main body 10 formed from a resin. The cassette main body 10 includes a bottom surface portion 10*a* and sidewall portions 10*b* to 10*e*. The sidewall portions 10*b* to 10*e* stand on the periphery of the bottom surface portion 10*a*. The cassette main body 10 has the shape of a flat box with an open top. The bottom surface portion 10*a* and the sidewall portions 10*b* to 10*e* form a paper accommodating section (a sheet accommodating section) S for accommodating the paper P.

A cassette cover (not illustrated) is attached to the sidewall portion 10*b* located upstream in the direction of insertion (the direction indicated by the arrow A1) of the paper feed cassette 1. The cassette cover forms a part of an exterior surface of the main body of the image forming apparatus 100 (see FIG. 1).

A sheet loading plate 20 is provided inside the cassette main body 10. The sheet loading plate 20 is formed from a metal plate and is electrically conductive. The sheet loading plate 20 is supported by the paper accommodating section S to pivot. An upstream end of the sheet loading plate 20 in the paper feed direction is attached to the paper accommodating section S such that the sheet loading plate 20 is pivotable. The paper P is loaded on the sheet loading plate 20. Note that the sheet loading plate 20 and a lift mechanism 25 that lifts up and down (i.e., causes the pivoting movement of) the sheet loading plate 20 will be described further below.

Further, a pair of side edge guides 30 standing along the paper feed direction (the direction indicated by the arrow B) is provided inside the cassette main body 10. The side edge guides 30 are brought into contact with side faces of a paper stack from respective opposite width directions (directions indicated by the arrows A1 and A2) to determine a position of the paper P in the width directions. The width directions refer to directions orthogonal to the paper feed direction.

The side edge guides 30 are movable along a groove 11 for the side edge guides. The groove 11 for the side edge guides is formed in the bottom surface portion 10*a* of the cassette main body 10 and extends in the width directions. Note that an unillustrated interlocking mechanism is provided below the pair of side edge guides 30. The interlocking mechanism operates the pair of side edge guides 30 such that one of the side edge guides moves along with movement of the other side edge guide. At this time, the side edge guides 30 move symmetrically with respect to a center line that extends through the center of the paper P in a width direction thereof.

A rear edge guide 35 is provided upstream in the paper feed direction inside the cassette main body 10. The rear edge guide 35 determines a position of the paper P in the paper feed direction such that the paper P is located at a specific paper feed position from which the paper P is fed by the paper feed mechanism 117 (see FIG. 1). The rear edge guide 35 is brought into contact with an end face of the paper stack from upstream in the paper feed direction. The rear edge guide 35 is movable along a groove 12 for the rear edge guide. The groove 12 for the rear edge guide is formed in the bottom surface portion 10*a* of the cassette main body 10 and extends in the paper feed direction.

A bent piece 20*a* is supported by a pivot 10*f* to pivot. The sheet loading plate 20 has a free end 20*b*. The free end 20*b* is a downstream end of the sheet loading plate 20 in the paper feed direction. The free end 20*b* is capable of being lifted up and down. That is, the free end 20*b* is lifted up and down along with pivoting movement of the sheet loading plate 20. The pivot 10*f* is formed on each of the inner surface of the sidewall portion 10*b* and the inner surface of the sidewall portion 10*d*. The inner surface of the sidewall portion 10*b* and the inner surface of the sidewall portion 10*d* are spaced apart from each other in the width directions and face each other. The sheet loading plate 20 includes the bent piece 20*a*. The bent piece 20*a* is formed at an upstream end of the sheet loading plate 20 in the paper feed direction. The bent piece 20*a* is attached to the cassette main body 10 to pivot. The sheet loading plate 20 pivots about the bent piece 20*a*. The sheet loading plate 20 is a plate-like member. The sheet loading plate 20 has cutouts in which the side edge guides 30 and the rear edge guide 35 move.

As illustrated in FIG. 3, a push-up plate driving shaft (a rotary shaft) 21 is located in the vicinity of the free end 20*b* of the sheet loading plate 20. The push-up plate driving shaft 21 is located below the free end 20*b*. The push-up plate driving shaft 21 is formed from a metal. The push-up plate driving shaft 21 is electrically conductive. The push-up plate driving shaft 21 is supported so as to be rotationally movable. The push-up plate driving shaft 21 is located below the sheet loading plate 20. The push-up plate driving shaft 21 extends in the width directions. That is, the push-up plate driving shaft 21 has a center axis extending in the width directions, and rotates about the center axis. The push-up plate driving shaft 21 is held by two bearings (not illustrated) so as to be rotatable. The two bearings are formed in the bottom surface portion 10*a* of the cassette main body 10. One of the bearings is located in a part (an end indicated by the arrow A1) of the bottom surface portion 10*a* near the sidewall portion 10*d*. The other bearing is located at a central part of the bottom surface portion 10*a* in the width directions (the directions indicated by the arrows A1 and A2). A proximal end 22*a* of the push-up plate 22 is fixed to the push-up plate driving shaft 21. Specifically, the proximal end 22*a* of the push-up plate 22 is fixed to a middle part of the push-up plate driving shaft 21. Therefore, the push-up plate 22 pivots together with the push-up plate driving shaft 21. Specifically, the push-up plate 22 pivots together with the push-up plate driving shaft 21 in a direction of rotation of the push-up plate driving shaft 21 about its axis. Further, the push-up plate 22 is formed from a metal plate. The push-up plate 22 is electrically conductive. The push-up plate 22 is located opposite to a substantially central part of the back surface of the sheet loading plate 20 in a width direction thereof. When the push-up plate driving shaft 21 rotationally moves in a state where a distal end 22*b* of the push-up plate 22 is in contact with the underside of the sheet loading plate 20, the push-up plate 22 causes the sheet loading plate 20 to pivot.

Figure 4:
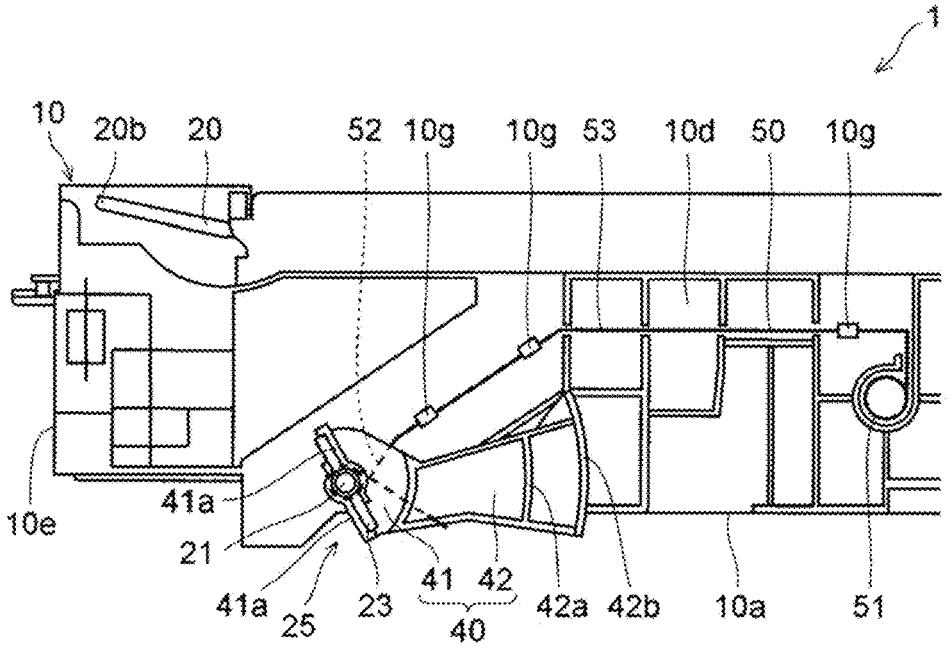
FIG. 4 is a side view illustrating a structure of the vicinity of a lift mechanism of the paper feed cassette according to the embodiment of the present disclosure, and illustrates a position of an actuator when the push-up plate and a sheet loading plate are located at a highest position.

As illustrated in FIG. 4, an end (an end indicated by the arrow A1 in FIG. 2) of the push-up plate driving shaft 21 protrudes outwardly from the sidewall portion 10*d*. The push-up plate driving shaft 21 is provided with an engagement pin (a coupling member) 23. The engagement pin 23 is provided on the push-up plate driving shaft 21. Specifically, the engagement pin 23 is fixed to the push-up plate driving shaft 21. The engagement pin 23 extends orthogonally to the rotation axis of the push-up plate driving shaft 21. Driving force that causes rotation of the push-up plate driving shaft 21 is input to the engagement pin 23. The cassette attachment section 101 (see FIG. 1) includes a coupling member (a coupled member) 120. The coupling member 120 is located at a position opposite to the engagement pin 23. The coupling member 120 transmits the driving force from a lift driving source 121 to the paper feed cassette 1. The lift driving source 121 is included in the image forming apparatus 100. The lift driving source 121 is a motor, for example. The lift driving source 121 is connected to the coupling member 120. The lift driving source 121 is connected to the coupling member 120 for example via gears and a clutch. The lift driving source 121 is provided in the main body of the image forming apparatus 100. The lift driving source 121 outputs the driving force that causes rotational movement of the push-up plate driving shaft 21 to the coupling member 120. The coupling member 120 inputs the driving force to the engagement pin 23. Specifically, when the paper feed cassette 1 is attached to the cassette attachment section 101, the engagement pin 23 is connected to the coupling member 120. When the engagement pin 23 is connected to the coupling member 120, the engagement pin 23 and the coupling member 120 form a coupling section. For example, in a state where the paper feed cassette 1 is attached to the cassette attachment section 101, the coupling section is formed by the coupling member 120 and the engagement pin 23 connected to a claw portion of the coupling member 120. When the coupling section is formed by the engagement pin 23 and the coupling member 120, the driving force is input from the coupling member 120 to the engagement pin 23. When the driving force is input to the engagement pin 23, the engagement pin 23 transmits the driving force to the push-up plate driving shaft 21. As a result, the push-up plate driving shaft 21 rotationally moves. That is, the push-up plate driving shaft 21 is rotationally moved by the driving force input to the engagement pin 23. Therefore, when the paper feed cassette 1 is attached to the cassette attachment section 101, the push-up plate driving shaft 21 is rotationally moved by the driving force from the lift driving source 121. The push-up plate 22, the push-up plate driving shaft 21, and the engagement pin 23 form the lift mechanism 25. The lift mechanism 25 lifts up and down (i.e., causes pivoting movement of) the sheet loading plate 20 between a lifted position X and a lowered position Y. The lifted position X is a position that permits feeding of the paper P from the paper accommodating section S. In a state where the sheet loading plate 20 is located at the lifted position X, the paper feed mechanism 117 feeds the paper P from the paper accommodating section S. As a result, the image forming section 106 forms an image on the paper P. The lowered position Y is a position that permits setting (supplying or replenishment) of the paper P to the paper accommodating section S. In a state where the sheet loading plate 20 is located at the lowered position Y, a user sets the paper P in the paper accommodating section S.

FIGS. 3 and 4 illustrate a state where the free end 20*b* of the sheet loading plate 20 is pushed up by the distal end 22*b* of the push-up plate 22. However, when the engagement pin 23 is not connected to the coupling member 120, the push-up plate 22 lies down along the bottom surface portion 10*a* of the cassette main body 10. As a result, the free end 20*b* of the sheet loading plate 20 descends to the lowest position. Also, the push-up plate 22 lies down when the push-up plate 22 and the sheet loading plate 20 are located (lie down) at the lowest position (the lowered position Y). Therefore, a load on the lift driving source 121 necessary for pushing up the sheet loading plate 20 becomes maximum. By contrast, the load on the lift driving source 121 necessary for pushing up the sheet loading plate 20 (or supporting the sheet loading plate 20) decreases as the push-up plate 22 pivots to reach a standing state. When the push-up plate 22 and the sheet loading plate 20 are located at the highest position (i.e., the state illustrated in FIG. 3), the load on the lift driving source 121 necessary for supporting the sheet loading plate 20 becomes minimum.

Figure 5:
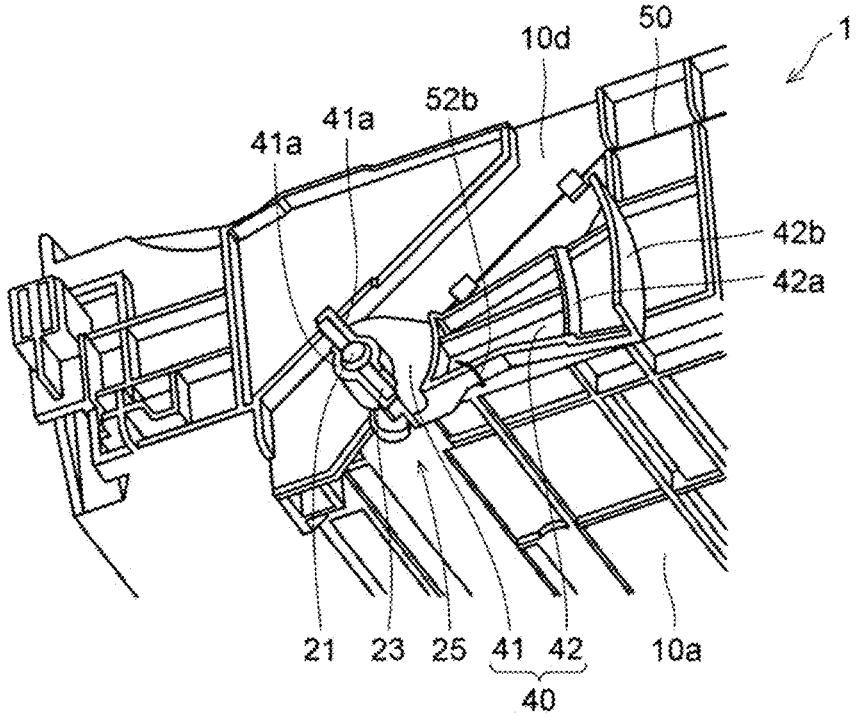
FIG. 5 is a perspective view illustrating the structure of the vicinity of the lift mechanism of the paper feed cassette according to the embodiment of the present disclosure.

Further, as illustrated in FIGS. 4 and 5, an actuator 40 is provided on the push-up plate driving shaft 21. The actuator 40 is fixed to the end of the push-up plate driving shaft 21. The actuator 40 is a member for detecting a paper residual amount (a sheet load amount) in the paper feed cassette 1. The actuator 40 includes an attachment portion 41 and a fan-shaped portion 42. The attachment portion 41 is attached to the push-up plate driving shaft 21. The fan-shaped portion 42 extends in radial directions of the push-up plate driving shaft 21.

The attachment portion 41 includes a pair of clamp parts 41*a*. The pair of clamp parts 41*a* is fixed to the engagement pin 23 such that the engagement pin 23 is held between the clamp parts 41*a* around the circumference of the push-up plate driving shaft 21. As a result of the above, the actuator 40 rotationally moves together with the engagement pin 23 and the push-up plate driving shaft 21.

The fan-shaped portion 42 includes a reinforcement rib 42*a* and an arc-shaped rib 42*b*. The arc-shaped rib 42*b* is provided along the arc at the end of the fan-shaped portion 42. The arc-shaped rib 42*b* protrudes in the axial direction (the direction of insertion of the paper feed cassette 1 (the direction indicated by the arrow A1)) of the push-up plate driving shaft 21. The cassette attachment section 101 includes a paper residual amount detection sensor (a detection sensor) 118. The paper residual amount detection sensor 118 includes a light emitter and a light receiver. The light emitter and the light receiver are located opposite to each other in a radial direction of the arc-shaped rib 42*b* such that the arc-shaped rib 42*b* is interposed therebetween. For example, two paper residual amount detection sensors 118 are located along a trajectory of the arc-shaped rib 42*b*. When the push-up plate driving shaft 21 and the actuator 40 rotationally move as a result of a change in the paper residual amount (sheet load amount) on the sheet loading plate 20, a light path between the light emitter and the light receiver shifts between a light-transmitted state and a light-blocked state. Therefore, the residual amount of the paper P on the sheet loading plate 20 can be detected with four levels using the two paper residual amount detection sensors 118. That is, the paper residual amount detection sensor 118 detects the residual amount of the paper P (sheet load amount) on the sheet loading plate 20 by sensing the actuator 40.

Figure 6:
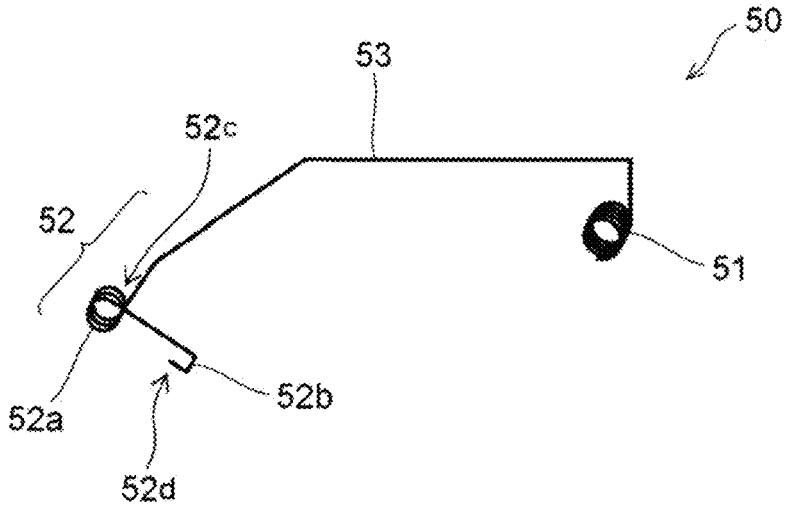
FIG. 6 is a perspective view illustrating a structure of an earth spring of the paper feed cassette according to the embodiment of the present disclosure.

An earth spring (an urging member) 50 is provided on the outer surface of the sidewall portion 10*d* of the cassette main body 10. The earth spring 50 is formed from a metal wire. The earth spring 50 is electrically conductive. The earth spring 50 urges the actuator 40 in a specific direction Z. The earth spring 50 urges the push-up plate 22 in the specific direction Z. The specific direction Z is a direction in which the sheet loading plate 20 pivots toward the lowered position Y. As illustrated in FIGS. 4 and 6, the earth spring 50 includes an earth portion 51, a torsion spring 52, and a junction portion 53. The earth portion 51, the torsion spring 52, and the junction portion 53 are integrally formed with each other. The earth portion 51 has a coil-like shape. The earth portion 51 is located at an end of the earth spring 50 and projects in the direction of attachment (the direction indicated by the arrow A1) of the paper feed cassette 1. The torsion spring 52 is located at the other end of the earth spring 50. The junction portion 53 connects the earth portion 51 and the torsion spring 52. That is, the junction portion 53 is connected with the earth portion 51 and the torsion spring 52. The junction portion 53 is fixed to the cassette main body 10 by a plurality of (here, three) fixing pieces 10*g* provided on the outer surface 10*h* of the sidewall portion 10*d*. The outer surface 10*h* of the sidewall portion 10*d* is a surface of the sidewall portion 10*d* that faces the outside of the paper feed cassette 1 (the cassette main body 10 formed from a resin). The outer surface 10*h* forms the paper accommodating section S. In a state where the paper feed cassette 1 is attached to the cassette attachment section 101, the earth portion 51 is in press contact with an unillustrated grounding metal plate (electrically conductive member). The grounding metal plate is electrically conductive. The grounding metal plate is provided in the cassette attachment section 101. The earth portion 51 is electrically grounded to the cassette attachment section 101. The earth portion 51 is electrically grounded to an unillustrated main body frame (electrically conductive member) via the grounding metal plate. The main body frame is formed from a metal. The main body frame is electrically conductive.

The torsion spring 52 is provided in order to urge the actuator 40 in the specific direction Z. The specific direction Z is a direction in which the push-up plate 22 and the sheet loading plate 20 move to lie down. In the present embodiment, the specific direction Z is a counter-clockwise direction in FIG. 4. Also, in the present embodiment, the specific direction Z is the direction in which the sheet loading plate 20 pivots toward the lowered position Y. The torsion spring 52 includes a coil part 52*a* (see FIG. 6) and an engagement part 52*b*. The torsion spring 52 is fitted around the push-up plate driving shaft 21. Specifically, the coil part 52*a* is fitted around the push-up plate driving shaft 21. The engagement part 52*b* is located at another end of the earth spring 50 (i.e., an end of the earth spring 50 opposite to the end at which the earth portion 51 is located). The coil part 52*a* is in sliding contact with the circumferential surface of the push-up plate driving shaft 21. Therefore, the sheet loading plate 20 is electrically grounded via the earth spring 50, the push-up plate driving shaft 21, and the push-up plate 22. An end (a first end) 52*c* of the torsion spring 52 is connected with the junction portion 53. The end 52*c* of the torsion spring 52 is fixed to the paper accommodating section S. Another end (an end of the torsion spring 52 opposite to the end connected with the junction portion 53) 52*d* of the torsion spring 52 includes the engagement part 52*b* and is rotationally movable together with the push-up plate driving shaft 21. Specifically, the engagement part 52*b* rotationally moves about the push-up plate driving shaft 21 together with the push-up plate driving shaft 21. The other end (a second end) 52*b* of the torsion spring 52 urges the actuator 40.

Figure 7:
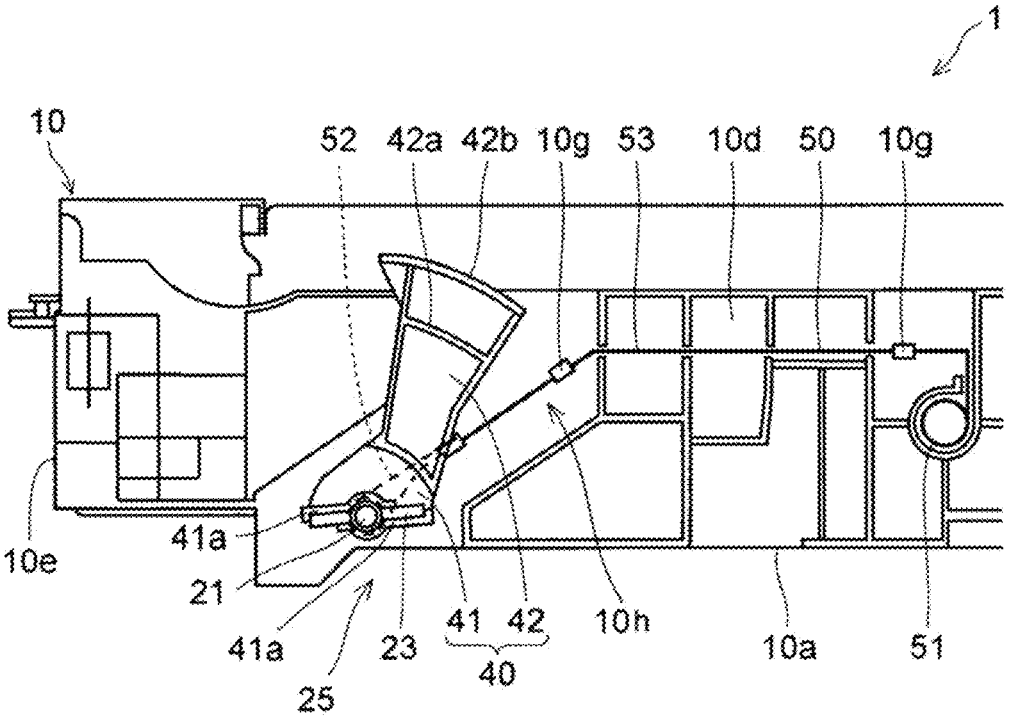
FIG. 7 is a side view illustrating the structure of the vicinity of the lift mechanism of the paper feed cassette according to the embodiment of the present disclosure, and illustrates a position of the actuator when the push-up plate and the sheet loading plate are located at a lowest position.

The engagement part 52*b* is bent into a substantial U-shape. The engagement part 52*b* engages with the actuator 40. Specifically, as illustrated in FIG. 5, the engagement part 52*b* engages with the lower surface of the actuator 40. In a natural state where no external load is applied to the engagement part 52*b*, the engagement part 52*b* is substantially parallel to the end 52*c* of the torsion spring 52 connected with the junction portion 53. Therefore, when the push-up plate 22 and the sheet loading plate 20 are located at the lowest position (i.e., a state illustrated in FIG. 7), the engagement part 52*b* is substantially not urged toward the actuator 40. As a result, urging force of the torsion spring 52 becomes minimum (in the present embodiment, zero). By contrast, when the lift driving source 121 is operated and the driving force is transmitted to the push-up plate driving shaft 21 via the coupling section, the push-up plate driving shaft 21 rotationally moves. When the push-up plate driving shaft 21 rotationally moves, the torsion spring 52 is expanded by the actuator 40. At this time, the push-up plate driving shaft 21 rotationally moves in the clockwise direction against the urging force of the engagement part 52*b*. As a result, the push-up plate 22 and the sheet loading plate 20 pivot (are lifted) in the clockwise direction. When the push-up plate 22 and the sheet loading plate 20 have pivoted to the highest position (i.e., the state illustrated in FIGS. 3 and 4), the urging force of the torsion spring 52 becomes maximum.

In a state where the push-up plate 22 is lying down, when the engagement pin 23 is connected to the coupling member 120 and the lift driving source 121 is operated, the push-up plate driving shaft 21 rotationally moves. Along with the rotational movement of the push-up plate driving shaft 21, the push-up plate 22 pivots in the clockwise direction in FIG. 3 and the free end (distal end) of the push-up plate 22 slides along the back surface of the sheet loading plate 20. As a result, the free end 20*b* of the sheet loading plate 20 is pushed up and lifted. When the free end 20*b* of the sheet loading plate 20 is lifted, the uppermost sheet of the paper P on the sheet loading plate 20 comes into contact with the pickup roller 113 of the paper feed mechanism 117 included in the image forming apparatus 100. In the state where the uppermost sheet of the paper P is in contact with the pickup roller 113, the paper P is fed by the paper feed roller pair 115 sheet by sheet from the paper feed cassette 1 to the paper conveyance section 103.

As the paper P on the sheet loading plate 20 is supplied (i.e., as the paper residual amount decreases), an amount of the rotational movement of the push-up plate driving shaft 21 increases. Along with the increase in the amount of the rotational movement of the push-up plate driving shaft 21, an amount of the pivoting movement of the push-up plate 22 increases. Along with the increase in the amount of the pivoting movement of the push-up plate 22, an angle between the bottom surface portion 10*a* of the cassette main body 10 and the push-up plate 22 increases. When all sheets of the paper P on the sheet loading plate 20 are supplied, the push-up plate 22 is located at the highest position (the position illustrated in FIG. 3) and stands at a specific angle relative to the bottom surface portion 10*a* of the cassette main body 10. Also, when all the sheets of the paper P on the sheet loading plate 20 are supplied, the free end 20*b* of the sheet loading plate 20 is lifted to the highest position.

As described above, the present embodiment includes the torsion spring 52 that urges the actuator 40 and the push-up plate 22 in the direction in which the sheet loading plate 20 pivots toward the lowered position Y. Therefore, when the paper feed cassette 1 is pulled out from the main body of the image forming apparatus 100 and coupling (connection) between the lift driving source 121 and the push-up plate driving shaft 21 is released, the push-up plate driving shaft 21 is rotationally moved in the specific direction Z by the urging force of the torsion spring 52. Further, the push-up plate driving shaft 21 is rotationally moved in the specific direction Z by pivoting movement of the sheet loading plate 20 caused by gravity. Therefore, the sheet loading plate 20 and the push-up plate 22 are surely lowered when the paper feed cassette 1 is pulled out from the main body (the cassette attachment section 101) of the image forming apparatus 100. That is, when the paper feed cassette 1 is pulled out from the cassette attachment section 101, connection between the coupling member 120 and the engagement pin 23 is released. As a result of the release of the connection between the coupling member 120 and the engagement pin 23, input of the driving force from the coupling member 120 to the engagement pin 23 is cut off. Therefore, the driving force does not act on the push-up plate driving shaft 21. As a result, when the paper feed cassette 1 is pulled out from the cassette attachment section 101, the push-up plate 22 is caused to pivot in the specific direction Z by the urging force of the torsion spring 52.

Further, when the paper accommodating section S is filled with the paper P in a state where the push-up plate 22 and the sheet loading plate 20 have pivoted to the lowest position (i.e., lying down), a load on the lift driving source 121 of the image forming apparatus 100 becomes maximum. By contrast, when the paper accommodating section S is filled with the paper P in the state where the push-up plate 22 and the sheet loading plate 20 are located at the lowest position (i.e., lying down), the urging force of the torsion spring 52 becomes minimum (in the present embodiment, zero). Therefore, although the torsion spring 52 is provided, an increase in the maximum load on the lift driving source 121 of the main body of the image forming apparatus 100 is reduced or prevented (in the present embodiment, the maximum load on the lift driving source 121 is not increased).

Further, the torsion spring 52 is fitted around the push-up plate driving shaft 21 as described above. Therefore, there is no need to provide a space especially for the torsion spring 52.

Further, due to the earth spring 50 provided as described above, static electricity accumulated on the sheet loading plate 20 as a result of contact with the paper P can be easily released to the main body of the image forming apparatus 100. Also, the torsion spring 52 is formed integrally with the earth spring 50 at the other end thereof. Therefore, the number of components is not increased.

Also, the junction portion 53 is fixed to the outer surface 10*h* of the sidewall portion 10*d* as described above. Further, the other end 52*d* of the torsion spring 52 engages with the actuator 40 fixed to the push-up plate driving shaft 21. Through the above, the push-up plate driving shaft 21 and the actuator 40 can be easily urged in the opposite direction (the direction in which the push-up plate 22 descends) by the torsion spring 52.

It should be noted that all aspects of the embodiment disclosed herein are examples and not intended as specific limitations. The scope of the present disclosure is defined by claims not by the above-described embodiment, and encompasses all alterations and equivalents within the scope of the claims.

For example, in the above-described embodiment, the present disclosure is applied to a monochrome-printing multifunction peripheral as illustrated in FIG. 1. However, the present disclosure is not limited to this configuration. It goes without saying that the present disclosure is applicable to various image forming apparatuses such as a color-printing multifunction peripheral, a monochrome printer, a color printer, a monochrome copier, a color copier, and a facsimile machine. Note that each of the image forming apparatuses includes the sheet loading plate and the sheet accommodating cassette. The sheet accommodating cassette includes the lift mechanism.

In the above-described embodiment, the engagement pin 23 is provided as the connecting member. However, the present disclosure is not limited to this configuration. For example, a gear may be provided as the connecting member. The connecting member refers to a member to which driving force is input from the main body (the coupling member 120) of the image forming apparatus 100.

In the above-described embodiment, the torsion spring 52 is a part of the earth spring 50. However, the present disclosure is not limited to this configuration. The torsion spring may be separate from the earth spring.

In the above-described embodiment, the torsion spring 52 is used as the urging member. However, the present disclosure is not limited to this configuration. For example, a compressed coil spring, a tension coil spring, or a leaf spring may be used as the urging member.

The invention claimed is:

1. A sheet accommodating cassette attachable to and detachable from a cassette attachment section of an apparatus main body, the sheet accommodating cassette comprising:

a sheet accommodating section configured to accommodate sheets;

a sheet loading plate that is supported on a bottom surface portion of the sheet accommodating section to pivot, and on which the sheets are loaded; and a lift mechanism configured to cause the sheet loading plate to pivot between a lowered position and a lifted position, the lowered position being a position at which the sheet loading plate lies down along the bottom surface portion, the lifted position being a position that is located above the lowered position to feed the sheets, wherein the lift mechanism includes:

a rotary shaft supported in the sheet accommodating section and extending in a width direction perpendicular to a feeding direction of the sheets;

a push-up plate that projects from the rotary shaft and lifts up and down the sheet loading plate by pivoting about the rotary shaft while a distal end of the push-up plate being in contact with a lower surface of the sheet loading plate;

a coupling member that is provided at an end of the rotary shaft and to which driving force is input from the cassette attachment section;

an actuator projecting from the end of the rotary shaft; and an urging member that urges the actuator in a direction in which the sheet loading plate pivots toward the lowered position, the urging member includes a torsion spring fitted around the rotary shaft, and the torsion spring has a first end fixed to the sheet accommodating section and a second end opposite to the first end, the second end urging the actuator.

2. The sheet accommodating cassette according to claim 1, wherein each of the sheet loading plate, the push-up plate, the rotary shaft, and the urging member is electrically conductive, the torsion spring is included in an electrically conductive earth spring including a junction portion and an earth portion integrally formed with the torsion spring, the junction portion extending from the first end of the torsion spring, the earth portion connected with an end of the junction portion, the earth portion has a coil-like shape and projects from an outer surface of a side wall portion of the sheet accommodating section in a direction of attachment of the sheet accommodating cassette, and in a state where the sheet accommodating cassette is attached to the cassette attachment section, the earth portion is in press contact with an electrically conductive member provided in the cassette attachment section and is electrically grounded to the cassette attachment section.

3. The sheet accommodating cassette according to claim 2, wherein the junction portion is fixed to the outer surface of the side wall portion of the sheet accommodating section, and the second end of the torsion spring is rotationally movable together with the rotary shaft.

4. The sheet accommodating cassette according to claim 3, wherein the actuator is a detection target piece sensed by a detection sensor that is provided in the apparatus main body, the detection sensor detecting an amount of the sheets loaded on the sheet loading plate by sensing the actuator, and the second end of the torsion spring includes an engagement part engaging with the actuator.

5. An image forming apparatus comprising:

a sheet accommodating cassette according to claim 1;

the apparatus main body including the cassette attachment section; and an image forming section provided in the apparatus main body.

6. An image forming apparatus comprising:

a sheet accommodating cassette;

an apparatus main body including a cassette attachment section;

an image forming section; and a coupled member, wherein the sheet accommodating cassette is attachable to and detachable from the cassette attachment section of the apparatus main body, the sheet accommodating cassette includes:

a sheet accommodating section configured to accommodate sheets;

a sheet loading plate that is supported on a bottom surface portion of the sheet accommodating section to pivot, and on which the sheets are loaded; and a lift mechanism configured to cause the sheet loading plate to pivot between a lowered position and a lifted position, the lowered position being a position at which the sheet loading plate lies down along the bottom surface portion, the lifted position being a position that is located above the lowered position to feed the sheets, the lift mechanism includes:

a rotary shaft supported in the sheet accommodating section and extending in a width direction perpendicular to a feeding direction of the sheets;

a push-up plate that projects from the rotary shaft and lifts up and down the sheet loading plate by pivoting about the rotary shaft while a distal end of the push-up plate being in contact with a lower surface of the sheet loading plate;

a coupling member that is provided at an end of the rotary shaft and to which driving force is input from the cassette attachment section;

an actuator projecting from the end of the rotary shaft; and an urging member that urges the actuator in a direction in which the sheet loading plate pivots toward the lowered position, the image forming section is provided in the apparatus main body, the coupled member is configured to be connected with the coupling member and input the driving force, when the sheet accommodating cassette is attached to the cassette attachment section, the coupling member is connected with the coupled member, and when the sheet accommodating cassette is pulled out from the cassette attachment section, the connection between the coupling member and the coupled member is released, and the sheet loading plate is caused to pivot toward the lowered position by gravity while being urged by the urging member toward the lowered position.

* * * * *